US006595410B2

(12) United States Patent
Lee et al.

(10) Patent No.: US 6,595,410 B2
(45) Date of Patent: Jul. 22, 2003

(54) HYGIENIC PAPER PACK

(76) Inventors: Seahuy Lee, 48-368, Chungchun-dong, Bupyung-gu, Inchon 403-854 (KR); Jaehwon Lee, 20-101, Anyangbon Villa, #91-21, Anyang-1-dong, Manan-gu, Anyang-si, Kyonggi-do 403-814 (KR); Jaesun Lee, 107-202, Gilun Cityvil, #556, Gajung-3-dong, Seo-gu, Inchon 404-805 (KR)

( * ) Notice: Subject to any disclaimer, the term of this patent is extended or adjusted under 35 U.S.C. 154(b) by 0 days.

(21) Appl. No.: 09/913,058

(22) PCT Filed: Dec. 7, 2000

(86) PCT No.: PCT/KR00/01418

§ 371 (c)(1),
(2), (4) Date: Jan. 29, 2002

(87) PCT Pub. No.: WO01/42093

PCT Pub. Date: Jun. 14, 2001

(65) Prior Publication Data

US 2002/0134826 A1 Sep. 26, 2002

(30) Foreign Application Priority Data

Dec. 7, 1999 (KR) ..... 1999/55635

(51) Int. Cl.[7] ..... B65D 5/42; B65D 45/00

(52) U.S. Cl. ..... 229/125.42; 229/128; 53/376.4; 53/491

(58) Field of Search ..... 229/125.42, 128, 229/213, 214, 216, 249; 53/376.4, 491

(56) References Cited

U.S. PATENT DOCUMENTS 2,220,746 A * 11/1940 Wentz ..... 229/213
2,305,365 A 12/1942 Wentz
2,470,199 A * 4/1949 Vivian ..... 229/213
3,770,185 A * 11/1973 Reeves ..... 229/213
3,797,726 A * 3/1974 Reil ..... 229/216
4,568,018 A 2/1986 Husnik et al.
4,784,272 A * 11/1988 Lisiecki et al. ..... 229/125.42
5,024,375 A 6/1991 Wright
5,462,222 A 10/1995 Boeck
5,501,394 A 3/1996 Eno
5,507,431 A 4/1996 Bertone
5,601,233 A * 2/1997 Kageyama et al. ..... 229/216
5,685,479 A * 11/1997 Weber-Caspers ..... 229/125.42
5,816,487 A 10/1998 Skinner

FOREIGN PATENT DOCUMENTS

DE 2990 9008 U1 10/1999

* cited by examiner

*Primary Examiner*—Gary E. Elkins

(57) ABSTRACT

The present invention relates to a paper pack for containing milk or beverages, etc. sanitary and for keeping the refrigerator cleanly preventing the smell. More particularly, it relates to a sanitary pack, which provides a method for opening and closing a paper pack without occurring any inconvenience, by sealing up the room of paper gap tightly as itself without any supplementary attachments or devices such as clip, pin, etc. this sanitary pack offer prevention of over flowing of the contents of beverage by falling over during its use after its opening and convenience of keeping the contents of beverage clean with easiness by folding the cutting section of the paper pack in the refrigerator as well. It is highly effective promoting the degree of airtight of paper pack itself.

18 Claims, 4 Drawing Sheets

HYGIENIC PAPER PACK

TECHNICAL FIELD

The present invention relates to a hygienic paper pack, and more particularly, to a hygienic paper pack capable of containing hygienically and cleanly the contents, such as milk, beverages, etc., in the paper pack (carton pack) made in the shape of hexahedron by using an opening and closing system for preventing a large gap from being generated due to widening of distal ends of opened wing portions in the paper pack after the paper pack has been already opened, so that the paper pack can inhibit the contents from being impregnated with smell of foods in a refrigerator.

BACKGROUND ART

In a conventional paper pack for containing milk, beverages, etc., when the residual contents in the paper pack are stored in a refrigerator or the like after the paper pack is opened so that its contents are consumed, distal ends of opened wing portions in the previously opened paper pack become wider. Thus, it is difficult to seal up the residual contents only by itself, so that the contents are easily exposed to the environment. Consequently, the contents in the paper pack are impregnated with the smell of various foods in the refrigerator and all kinds of bacteria living in the refrigerator may permeate into the contents. When the residual contents in the opened pack stored in the refrigerator are consumed again, there are various problems in that the residual contents may go bad and may not be hygienically clean, may be impregnated with the bad smell of foods, and the like. Therefore some approaches to the method for sealing up and storing the carton pack have been attempted, such as fitting of a pin (or a clip) into the carton pack, appliance of an adhesive to the carton pack, etc. However, the approaches have not been put to practical use because it is inconvenient and cumbersome to use them regardless of respective places.

DISCLOSURE OF INVENTION

Therefore, the present invention has been conceived to solve the above problems. The object of the present invention is to provide a hygienic paper pack, wherein the paper pack itself seals up opened wing portions of the paper pack to the utmost by preventing distal ends of the opened wing portions from becoming wider not to generate a gap so that the paper pack can cleanly, freshly and hygienically contain and store its contents within the term of distribution, does not cause any inconvenience and confusion in use and can prevent the contents from being gushed from the paper pack when the opened paper pack containing the contents is turned over inadvertently in its use.

In order to achieve the above object of the invention, the paper pack according to the present invention employs an easily opening and closing system by which the paper pack itself can promote the efficiency of sealing up the opened wing portions thereof to the utmost without attaching any separate supplementary materials or objects thereto so that the paper pack can hygienically and freshly contain and store its contents and simultaneously the paper pack in which its contents have been completely consumed can be recycled in a conventional manner without hindrance.

BEST MODE FOR CARRYING OUT THE INVENTION

Figure 1:
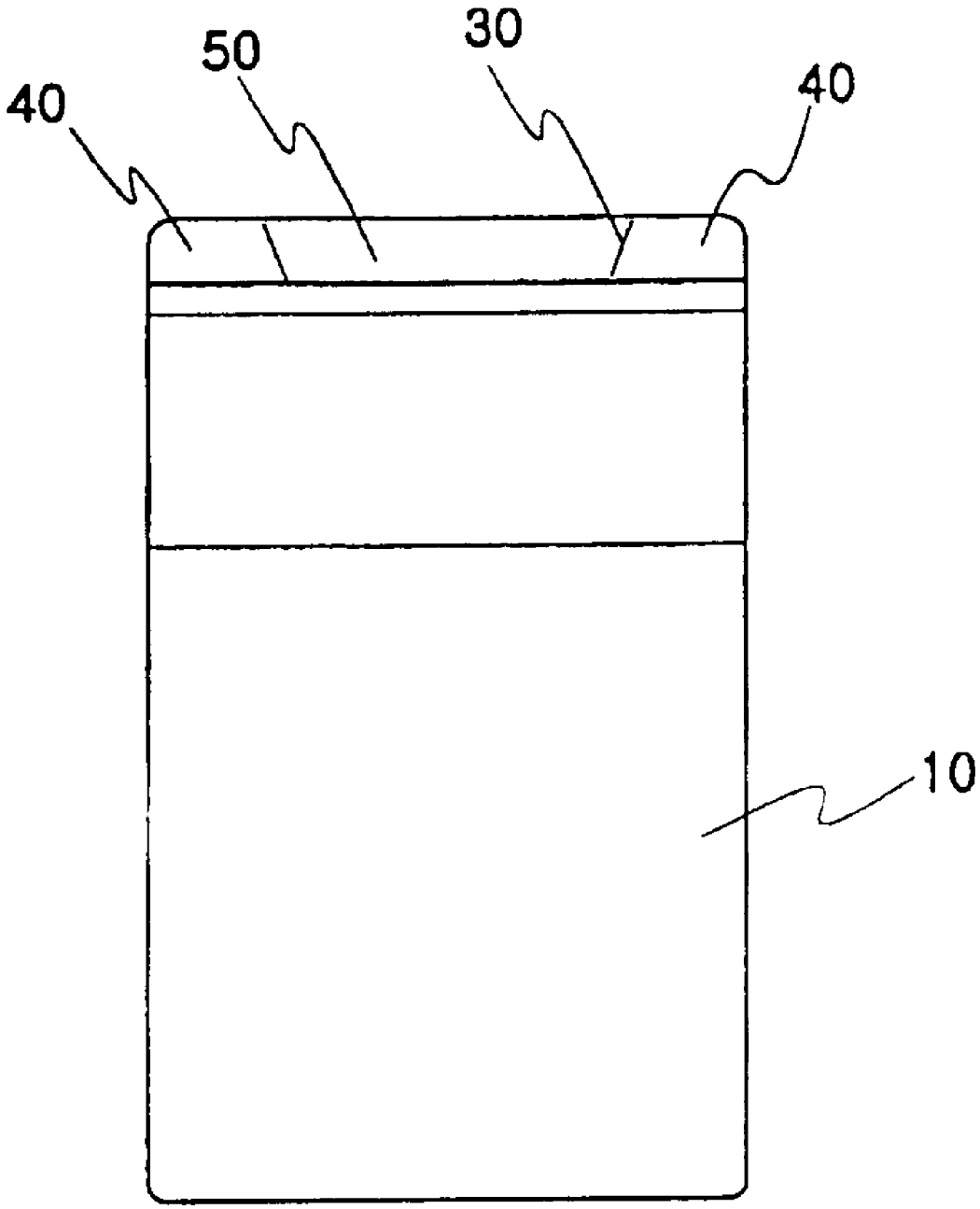
FIG. 1 is a front view showing a hygienic paper pack of a preferred embodiment according to the present invention.

Hereinafter, a preferred embodiment of the present invention will be explained in detail with reference to the drawings.

A hygienic paper pack of the present invention shown in FIGS. 1 to 4 is a paper pack for containing the contents, such as milk, beverages, etc. The paper pack has a characteristic feature that wing portions adhered to each other at both sides of the paper pack and forming certain portions of an uppermost portion of a paper pack body 10, are formed with cutting portions and that the portion between the portions can be folded thereabout.

Cutting (scored) portions of distal ends of wing portions 30 are formed in the shape of oblique line at both sides of the paper pack from the distal ends of wing portions 40, which form the certain portions of the uppermost portion of the paper pack body 10, to an upper portion of a lower end sunken groove 20 therebelow, so that an inverted trapezoidal folding portion 50 are formed so as to keep the distal ends of wing portions, which will have been opened, in close contact with each other.

The inverted trapezoidal folding portion 50 constructed by the cutting (scored) portions 30 at both sides of the paper pack can be folded forward or rearward of the paper pack between the upright distal ends of wing portions 40 at both sides, so that the opened distal ends of wing portions come into close contact with each other and are locked for preventing them from spontaneously becoming wider.

Next, FIG. 1 is a front view showing the hygienic paper pack of a preferred embodiment according to the present invention. It is shown in the figure that the folding portion 50 constructed by the cutting (scored) portions 30, which is a portion to be folded when the paper pack containing the contents is stored after being opened, takes the shape of inverted trapezoid, by forming the cutting, (scored) portions 30 in the shape of oblique line at both sides of the paper pack from the distal ends of wing portions 40, which form the certain portions of the uppermost portion of the paper pack body 10, to the upper portion of the lower end sunken groove 20 therebelow.

The cutting (scored) portions are constructed to have a partially severed structure, and thus, they can be easily severed in use.

Figure 2:
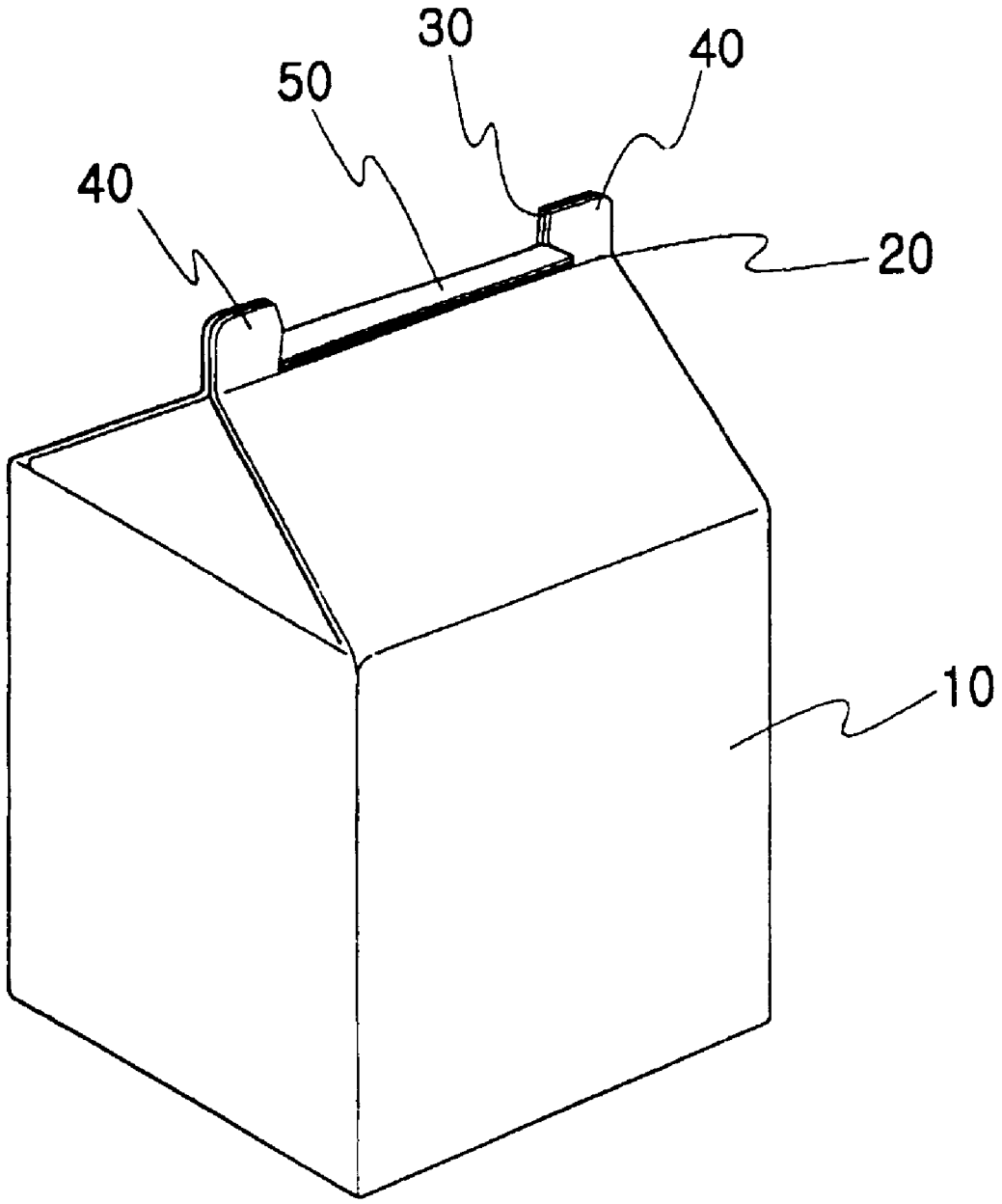
FIG. 2 is a perspective view showing the hygienic paper pack of the present invention with a folding portion thereof folded.

FIG. 2 is a perspective view showing the hygienic paper pack of the present invention with the folding portion thereof folded. It is shown in the figure that when the folding portion 50 is folded rearward after the cutting (scored) portions 30 at both sides of the paper pack are severed in order to close the previously opened paper pack again, the folding portion 50 and the cutting (scored) portion 30 form an inverted trapezoid together and simultaneously are folded. By forming the inverted trapezoidal shape, the cutting (scored) portions 30 serve as latches to be locked at oblique cutting portions of the distal ends of wing portions 40 and thus resist the force that intends to laterally widen the twofold distal ends of wing portions 40 which had been opened, so that a gap is not generated between the two-fold distal ends of wing portions 40.

Figure 3:
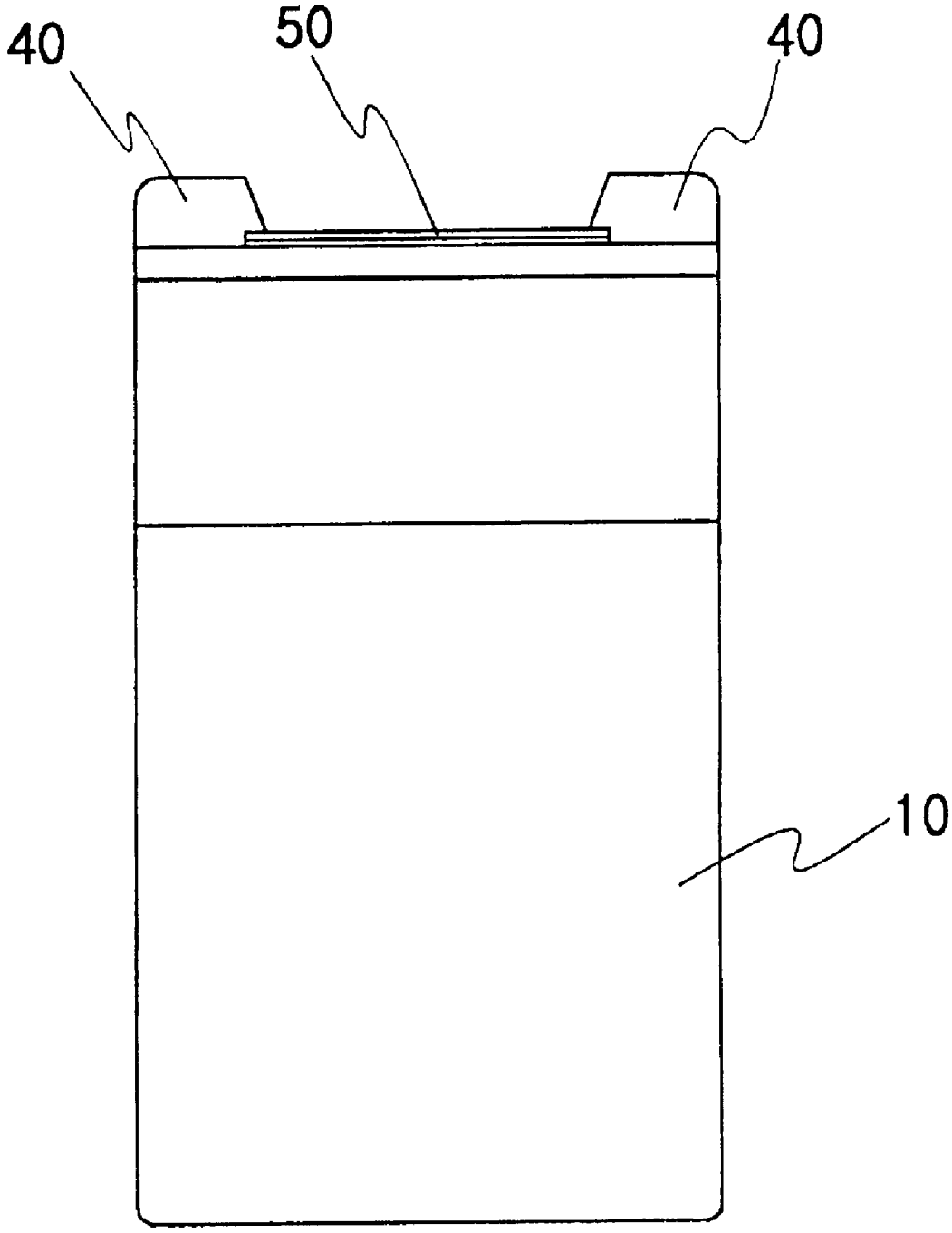
FIG. 3 is a front view showing the hygienic paper pack of the present invention with the folding portion thereof folded.

FIG. 3 is a front view showing the hygienic paper pack of the present invention with the folding portion thereof folded. It is shown in the figure that the cutting (scored) portions 30 at both sides of the paper pack are severed and the inverted trapezoidal folding portion is folded rearward when the contents in the previously opened paper pack are stored again.

Figure 4:
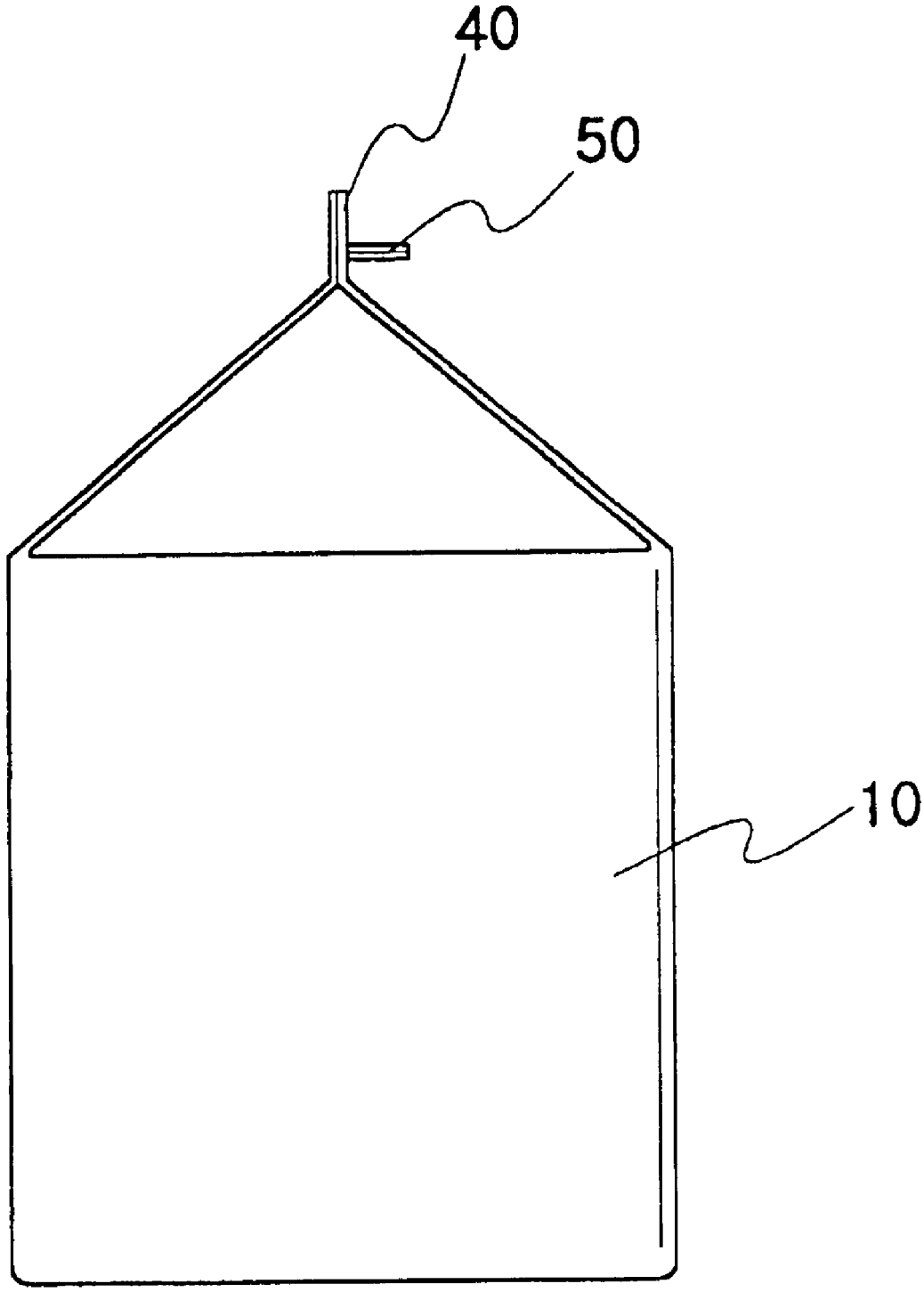
FIG. 4 is a side view showing the hygienic paper pack of the present invention with the folding portion thereof folded.

FIG. 4 is a side view showing the hygienic paper pack of the present invention with the folding portion thereof folded. If the inverted trapezoidal folding portion is laterally (in the figure) folded after the cutting (scored) portions 30 are severed, the folded, inverted trapezoidal folding portion including a central distal end is perpendicular to the upright distal ends of wing portions 40, so that the cutting (scored) portions 30 of the inverted trapezoidal folding portion serve as latches to be locked at oblique cutting portions of the distal ends of wing portions 40 and thus resist the force that intends to laterally widen the two-fold distal ends of wing portions 40. Consequently, a gap is not generated between the two-fold distal ends of win (portions 40.

For example, the present invention is not limited to the embodiment described above, and various modifications and changes to the present invention which can be easily made by a person having an ordinary skill in the art to which the present invention pertains without departing from the spirit and scope of the invention defined by the appended claims will fall within the scope of the invention.

INDUSTRIAL APPLICABILITY

As described with reference to the embodiment, according to the present invention, by providing the cutting portions in the form of oblique lines to cut (severe) them from the uppermost portion of the body of the hexahedron paper pack for containing milk, beverages, etc. to the upper portion of the lower end sunken groove and by easily folding the inverted trapezoidal folding portion laterally after the cutting is made along the cutting portions, there is provided the hygienic paper pack in which a gap between the opened distal ends of wing portions is reduced to the utmost. The hygienic paper pack has sealing advantages that it can not only cleanly, freshly and hygienically contain and store the contents but also seal up the paper pack for preventing the contents from being inadvertently gushed therefrom. In addition, since the present invention has an excellent advantage of highly improving the quality of the eating culture and preservation of health, the present invention is very useful in view of the food storage industry.

EXPLANATION OF THE REFERENCE NUMERALS TO THE MAJOR ELEMENTS IN THE DRAWINGS

10: Paper pack body
20: Lower end sunken groove
30: Cutting (scored) portions of distal ends of wing portions
40: Distal ends of wing portions
50: Folding portion

What is claimed is:

1. A gable-top container comprising:

a pair of opposing roof portions inclining toward each other and forming a ridge along where the roof portions meet;

a pair of extensions, each extending from each roof portion along the ridge, the pair of extensions together constituting a ridge strip;

a pair of tear lines formed on each extension, each tear line extending from about the ridge through an edge of the extension opposing the ridge;

a folding line formed on each extension;

wherein a folding portion is defined in each extension by the tear lines, the opposing edge and the folding line;

wherein the tear lines on one extension substantially overlap the tear lines on the other extension so that both of the folding portions can be torn away together along the tear lines; and wherein the folding portions are configured to be folded together along the folding lines to lock the container.

2. The gable-top container of claim 1, wherein the tear lines are scored lines.

3. The gable-top container of claim 1, wherein the tear lines are substantially linear.

4. The gable-top container of claim 3, wherein the substantially linear tear lines formed on each extension are slanted away from each other in a direction from the ridge to the opposing edge.

5. The gable-top container of claim 1, wherein the folding portion of each extension is in a trapezoidal shape.

6. The gable-top container of claim 1, wherein the folding line is located between the ridge and the opposing edge.

7. The gable-top container of claim 1, wherein the folding line is substantially parallel to the ridge.

8. The gable-top container of claim 1, wherein the container is made of paper.

9. A method of locking a gable top container opening, comprising:

providing the gable-top container in accordance with claim 3;

tearing the ridge strip along the tear lines; and folding the folding portions together along the folding lines, whereby the gable top container is locked.

10. The method of claim 9, wherein the tear lines are scored lines.

11. The method of claim 9, wherein the tear lines are substantially linear.

12. The method of claim 11, wherein the substantially linear tear lines formed on each of the extensions are slanted away from each other in a direction from the ridge to the opposing edge.

13. The method of claim 9, wherein the folding portion is in a trapezoidal shape.

14. The method of claim 9, wherein the folding line is located, between the ridge and the edge opposing to the ridge.

15. The method of claim 9, wherein the folding line is substantially parallel to the ridge.

16. The method of claim 9, wherein the folding portions are folded toward a direction substantially perpendicular to a plane of the ridge strip.

17. The method of claim 9, wherein the gable-top container contains liquid therein when folding the folding portions.

18. The method of claim 17, further comprising storing the gable-top container after the folding.

* * * * *